United States Patent [19]

Gifford

[11] 4,017,284

[45] Apr. 12, 1977

[54] AIR DISTILLATION APPARATUS COMPRISING REGENERATOR MEANS FOR PRODUCING OXYGEN

[75] Inventor: William E. Gifford, Syracuse, N.Y.

[73] Assignee: Cryox Corporation, Eden, N.Y.

[22] Filed: Dec. 6, 1974

[21] Appl. No.: 530,231

Related U.S. Application Data

[63] Continuation of Ser. No. 360,397, May 14, 1973, abandoned.

[52] U.S. Cl. ..... 62/40; 62/13; 62/29; 62/42

[51] Int. Cl.[2] ..... F25J 3/04

[58] Field of Search ..... 62/31, 32, 33, 34, 40, 62/44, 24, 9, 11, 12, 13, 22, 29, 14

[56] References Cited

UNITED STATES PATENTS

| | | | |
|---|---|---|---|
| 1,573,752 | 2/1926 | Seligmann | 62/32 |
| 1,602,535 | 10/1926 | LeRouge | 62/32 |
| 2,209,748 | 7/1940 | Schlitt | 62/31 |
| 2,505,774 | 5/1950 | Holm et al. | 62/13 |
| 2,585,912 | 2/1952 | Buschow | 62/13 |
| 2,820,352 | 1/1958 | Fokker et al. | 62/32 |
| 2,824,433 | 2/1958 | Köhler | 62/33 |
| 2,836,969 | 6/1958 | Köhler | 62/13 |
| 3,059,439 | 10/1962 | First et al. | 62/31 |
| 3,304,999 | 2/1967 | Ward | 62/13 |
| 3,517,521 | 6/1970 | Emerson | 62/22 |

*Primary Examiner*—Frank W. Lutter
*Assistant Examiner*—Frank Sever
*Attorney, Agent, or Firm*—Christel & Bean

[57] ABSTRACT

A method and apparatus for producing high purity oxygen gas wherein input ambient air is pressurized and then liquefied by passing the air in heat exchange relationship with a bath of liquid oxygen at the bottom of a distillation column having a cryogenic refrigeration source at the top thereof. The liquefied air is separated in the column into the oxygen and nitrogen components thereof, and high purity oxygen gas is collected. The oxygen gas is passed in heat exchange relationship with the input air to precool the input air before it is liquefied, and this is done in a regenerator having two identical portions each provided with separate regions through which air and oxygen flow in heat exchange relationship and having a switching valve means to alternate the flow of air through the portions.

10 Claims, 6 Drawing Figures

Fig. 2.
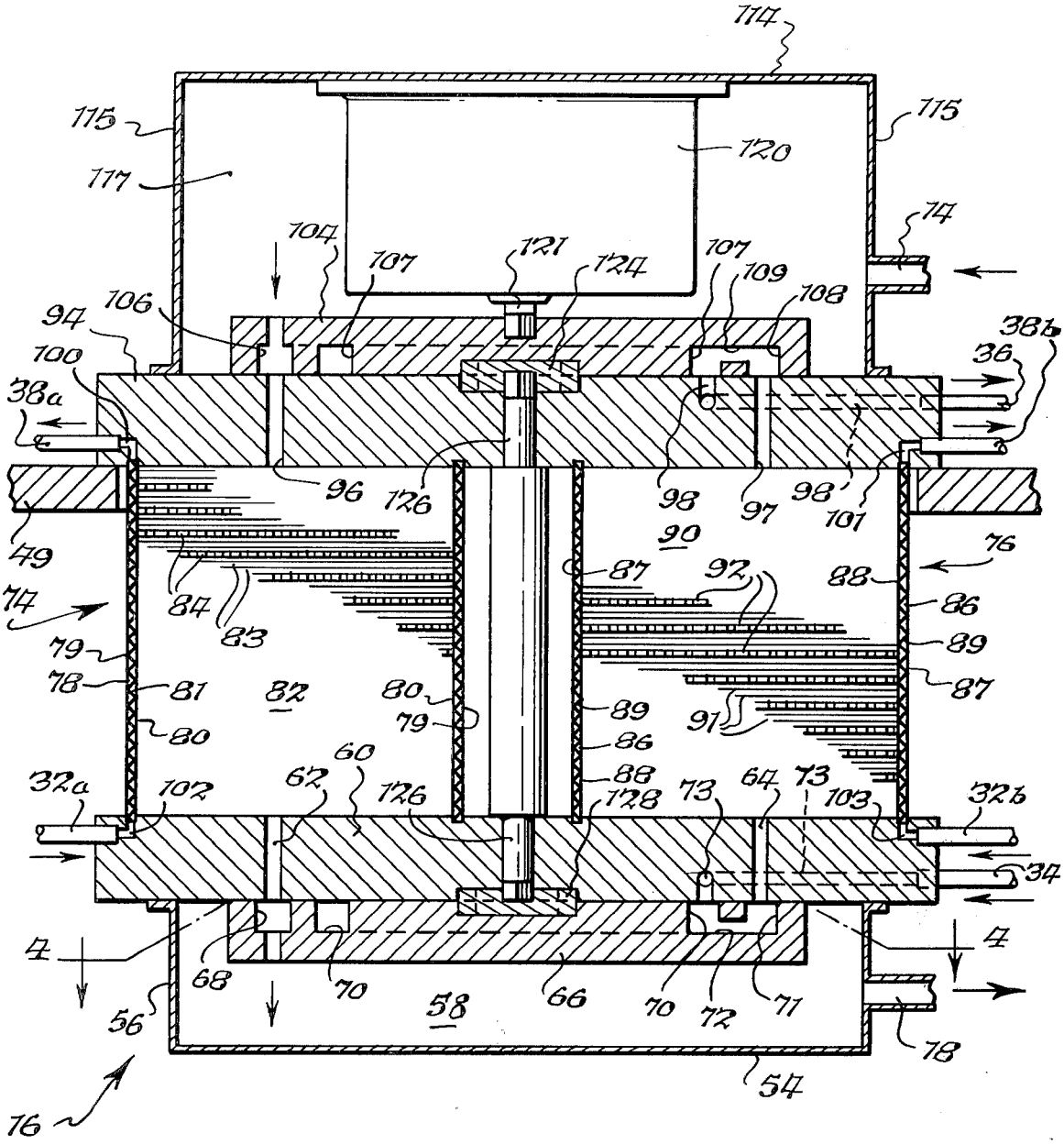
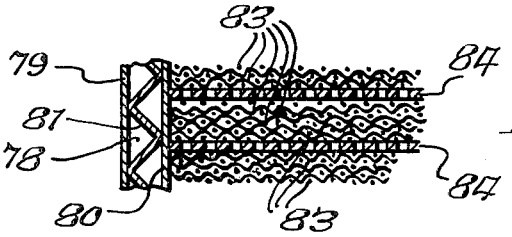
Fig. 3.

AIR DISTILLATION APPARATUS COMPRISING REGENERATOR MEANS FOR PRODUCING OXYGEN

The is a continuation of application Ser. No. 360,397, filed May 14, 1973, now abandoned.

BACKGROUND OF THE INVENTION

This invention relates to the production of high purity oxygen gas, and more particularly to a cryogenic method and apparatus for producing high purity oxygen gas from ambient air.

One area of use of the present invention is the production of oxygen gas having a high degree of purity required for medical uses and certain industrial uses although the principles of the present invention can be variously applied. Many users of high purity oxygen, such as hospitals, depend upon commercial suppliers who must ship the oxygen in its cold liquid form to the user. Hospitals in remote areas and in areas where bad weather conditions can interrupt travel for significant periods are faced with the risk of depleting oxygen supplies.

SUMMARY OF THE INVENTION

It would, therefore, be highly desirable to provide a method and apparatus for producing high purity oxygen from ordinary air at the place of use, such as a hospital. The apparatus should be efficient and economical in operation, of a size permitting it to be conveniently located with the user, and relatively economical to purchase and to maintain.

The present invention provides a method and apparatus for producing high purity oxygen gas wherein input ambient air is pressurized and then liquefied by passing the air in heat exchange relationship with a bath of liquid oxygen at the bottom of a distillation column having a cryogenic refrigeration source at the top thereof. The liquefied air is separated in the column into the oxygen and nitrogen components thereof, and high purity oxygen gas is collected. The oxygen gas passes in heat exchange relationship with the input air to precool the input air before it is liquefied.

While exemplary embodiments of the principles of the present invention are illustrated in the drawings and described in the following specification, it is to be understood that such embodiments are for the purpose of setting forth the operating principles of the present invention and the scope of the invention is not limited to such exemplary embodiments or otherwise than as defined in the appended claims.

BRIEF DESCRIPTION OF THE DRAWINGS

FIG. 2 is a vertical sectional view of the regenerator in the apparatus of FIG. 1;

FIG. 3 is an enlarged fragmentary sectional view of a portion of the apparatus of FIG. 2;

DETAILED DESCRIPTION OF THE ILLUSTRATED EMBODIMENT

Figure 1:
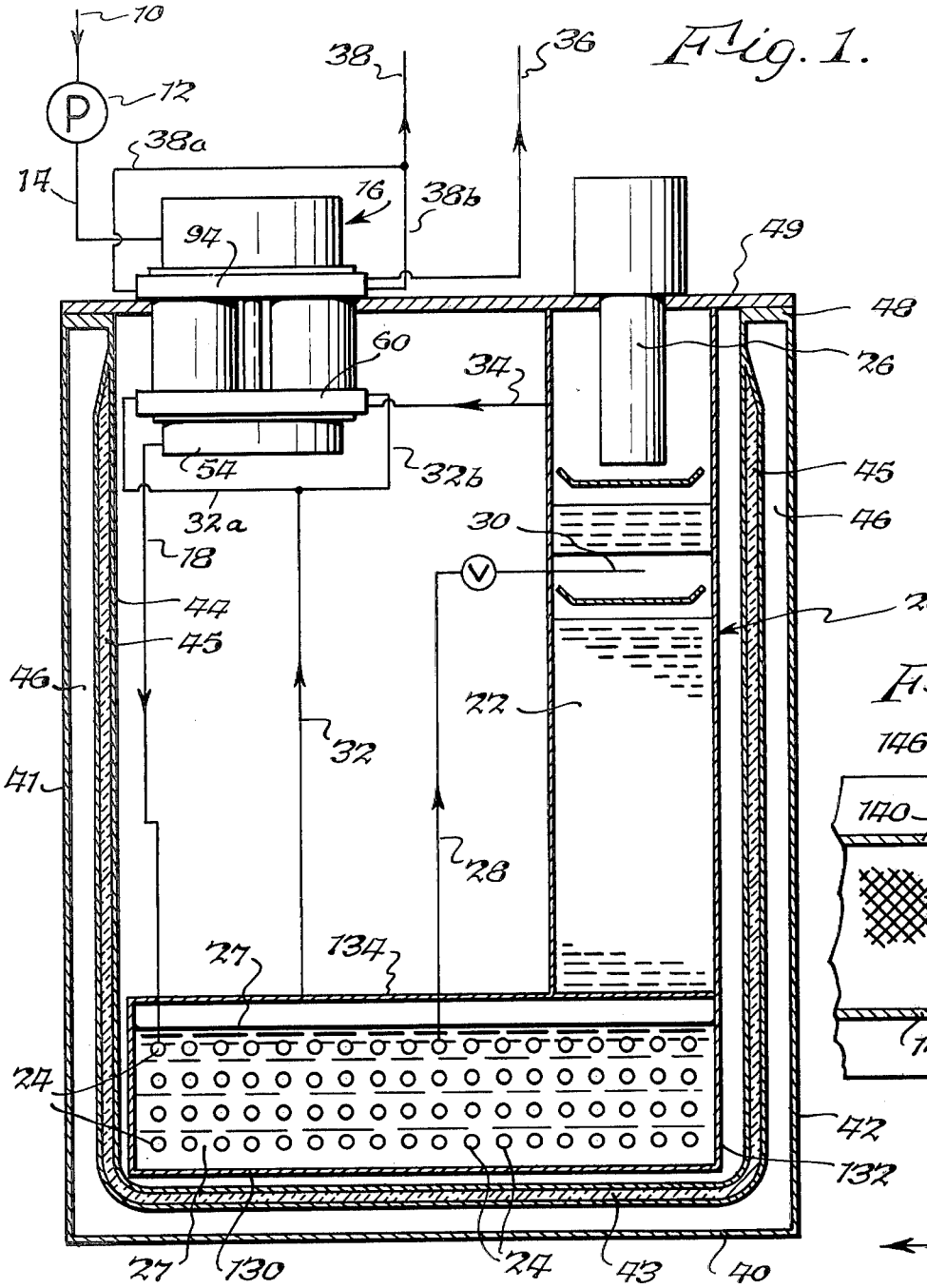
FIG. 1 is a vertical sectional view, partly diagrammatic, taken through a housing which encloses the apparatus of the present invention and showing some parts of the apparatus in section and others in elevation.

Referring now to FIG. 1, ambient air taken from the atmosphere surrounding the apparatus is conducted by a conduit 10 to the input of a compressor 12 wherein the air is converted to high pressure air available in a conduit 14 connected to the output of the compressor. According to a preferred mode of the present invention, the air pressure is increased to approximately 200 psi. so that the air can be liquefied further on in the process as will be described in detail presently. Accordingly, air compressor 12 has a range from about 1 atmosphere to about 14 atmospheres. Compressor 12 preferably is a two stage, three piston compressor driven by a twenty horsepower constant operating induction motor. Compressor 12 can be provided with a storage tank for the purpose of overcoming any pressure surges which might occur in the system conduits due to unusual oxygen needs. This tank preferably is equipped with a pressure transducer operative to start compressor 12 if tank pressure drops below the operating pressure of 200 psi. and which will stop compressor 12 when tank pressure rises above about 210 psi.

Conduit 14 is connected to the inlet of a heat exchanger 16 of the regenerator type. Regenerator 16 functions to reclaim the refrigeration produced subsequently in the apparatus and to precool the incoming air that is to be liquefied while at the same time serving as a filter system to remove impurities present in the incoming air. Regenerator 16 includes two portions or sections, and the flow of incoming air from conduit 14 and the flow of waste gas at low temperature from the remainder of the apparatus are flowed alternately through each regenerator portion. Oxygen produced by the apparatus also is flowed through regenerator 16 in heat exchange relationship with the incoming air, and the construction and operation of regenerator 16 will be described in detail presently. The precooled and filtered air under pressure is present in a conduit 18 connected to an output of the regenerator.

The apparatus further comprises a distillation column 20 including a region of rectification plates 22 or the equivalent in the column between a heat exchanger 24 in communication with the bottom or base of column 20 and a source of refrigeration 26 at the top of column 20. Conduit 18 containing the precooled, high pressure air is connected to the inlet of heat exchanger 24, and as the air flows through the heat exchanger it exchanges heat with a bath 27 of liquid oxygen which is several degrees colder than the air. The transfer of heat energy from the incoming high pressure air having a temperature of 92° Kelvin to the liquid oxygen causes some of the liquid oxygen to evaporate and some of the air to condense or liquefy. The boiling off of pure oxygen gas and condensing of the incoming air occurs simultaneously. A conduit 28 connects the outlet of heat exchanger 24 to an expansion nozzle 30 open to the interior of column 20 between region 22 and refrigeration source 26. As a result, the liquefied air is sprayed from nozzle 30 into the distillation column 20 where separation into components occurs. In order to maintain an equilibrium condition between the vapor pressure of oxygen and the vapor pressure of nitrogen within column 20, the rising vapor must increase in nitrogen content while the falling liquid increases in oxygen content. Adjacent the bottom or base of column 20, heat exchanger 24 causes the liquid oxygen to evaporate with the result that a portion thereof rises upwardly in column 20 to continue the process while the remainder is vented or exhausted through a conduit 32 to regenerator 16. In particular, the flow of oxygen in conduit is divided in half through the two branches 32*a* and 32*b* which conduits are connected to separate inlets of regenerator 16 which will be described in detail presently. Adjacent the top of distillation column 20, waste gas comprising about 93 percent nitrogen escapes through a conduit 34 connected to another inlet of regenerator 16. The relatively low temperature oxygen gas and waste nitrogen gas in conduits 32 and 34, respectively, are utilized by regenerator 16 to precool the incoming air as previously described. The waste gas then is removed from regenerator 16 by means of a conduit 36 through which it can be exhausted to the atmosphere outside of the building containing the apparatus, or alternatively the waste nitrogen gas in conduit 36 can be recovered or otherwise utilized as a byproduct. In this connection, the waste nitrogen gas flowing through conduit 36 has kinetic energy so it can be used to power or drive a machine such as a pump. Pure oxygen gas is removed from regenerator 16 through branch conduits 38a and 38b which merge into a single conduit 38 which, in turn, supplies the pure oxygen for its intended use.

The apparatus is housed in a vacuum chamber including thermal insulation for all cold regions of the apparatus so that any thermal losses will be kept very small. In particular, the vacuum chamber comprises an outer housing having a bottom 40 and upstanding walls, two of which are designated 41 and 42 in FIG. 1. The outer housing is hollow, open at one end, and can be rectangular or cylindrical in shape. The vacuum chamber further comprises an inner housing member of thermally insulating material including a bottom 43 and upstanding vertical walls 45. The inner housing is of a size permitting it to be placed within the outer housing so that a region or space 46 is defined therebetween. In preferred form, the upper ends of the sidewalls of the inner housing as viewed in FIG. 1 are formed to include outwardly-directed flange portions 47, 48 which are of sufficient length to contact and rest on the upper edge of the walls of the outer housing whereby the inner housing is supported on the outer housing. The inner housing preferably comprises ten layers of super insulation material. In this connection, each of the walls 43 and 45 is shown to be of a construction having inner and outer surface portions with material therebetween. Air is withdrawn from region 46 so that a vacuum exists between the inner and outer housings, and the junctures between the flanges of the inner housing and the edges of the outer housing can be sealed with suitable material. Alternatively, the inner and outer housings can be of an integral construction, with a valved opening (not shown) to region 46 for creating the vacuum. The chamber is completed by a top or cover member 49 which closes the open end of the chamber and which is provided with openings of the appropriate size for holding regenerator 16 and refrigeration source 26 so that part of each element extends out from cover 49 and the remainder is in the chamber as shown in FIG. 1. Cover 49 is sealed around its periphery to the housings in a suitable manner and is supported thereon whereby cover 49 in turn supports regenerator 16 and refrigeration source 26. Distillation column 20 and the heat exchanger 24 and liquid oxygen bath 27 are supported in the inner housing.

Figure 4:
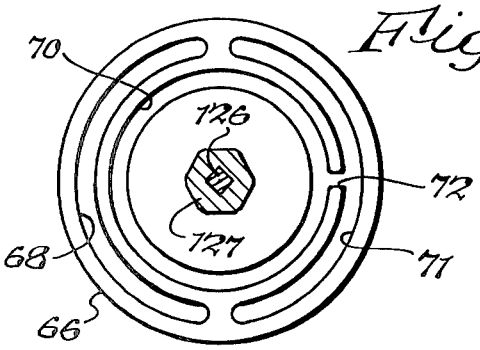
FIG. 4 is a sectional view taken about on line 4—4 of FIG. 2.

FIGS. 2–4 show a preferred construction for regenerator 16. A generally cup-shaped housing comprising a bottom wall 54 and a generally vertical annular wall 56 defines a chamber 58 which is connected to conduit 18 in the system of FIG. 1. A closure member 60 or base in the form of a metal disk having an outer diameter larger than the diameter of annular wall 56 is secured to the edge of wall 56 in a manner closing chamber 58. Closure member 60 is provided with spaced-apart bores or passages 62, 64, allowing a flow of air between chamber 58 and other portions of regenerator 16 under control of a movable or rotatable valve element 66 in the form of a generally disk-shaped member having an outer diameter less than the inner diameter of wall 46 and which is rotatably carried by closure 60 and extends into chamber 58. Valve 66 includes a first passage 68 which when the valve is in the position shown in FIG. 2 allows communication between passage 62 of closure 60 and chamber 58. In particular, passage 68 includes a portion disposed generally parallel to the axis of element 66, i.e. vertically as viewed in FIG. 2, to connect passage 62 with chamber 58, and a portion extending along and spaced from the outer edge of element 66 for slightly less than the circumference thereof, this portion being disposed generally perpendicular to the axis of element 66, i.e. horizontally as viewed in FIG. 4. Valve 66 is provided with a second passage 70 which is continuous, annular and positioned between passage 68 and the center of valve element 66. Passage 70 is disposed similar to passage 68, i.e. horizontally in FIG. 2. A third passage 71 is provided in valve element 66 in a manner whereby it is positioned and shaped in a mirror image of passage 71. Passage 71 has a vertical portion as viewed in FIG. 2. to connect with passage 64. The horizontal portion of passage 71 is connected through a passage 72 to annular passage 70. Closure member 66 is provided with a passage 73 which is located so as to connect annular passage 70 of valve element 66 with conduit 34 in the system of FIG. 1.

Regenerator 16 comprises first and second regenerator elements or portions 74 and 76, respectively, each being cylindrical in shape and placed against the surface of closure 60 opposite the surface having valve element 66. Each cylindrical regenerator 74, 76 is disposed so that the longitudinal axis thereof is perpendicular to the surface of closure 60. Regenerator portion 74 comprises an outer, annular region or shell 78 defined by concentric walls 79, 80 as shown in FIG. 3 and provided with threads 81 which in the present illustration have a width of 0.030 inch and depth of 0.040 inch. An interior region 82 of regenerator 74 includes packing material 83 which occupies about 35 percent of the total interior volume. Wall 80 separating regions 78 and 82 is of thermally conducting material such as copper, whereas the outer shell or wall 79 is of stainless steel or a similar poor conductor of heat. The packing material 83 preferably comprises 200 mesh bronze metal screen. The interior of regenerator portion 74 also is provided with perforated plates or screens 84 disposed perpendicular to the longitudinal axis thereof and positioned at regular axial intervals. In preferred form plates 84 comprise perforated copper discs each having a thickness of 0.020 inch and a diameter substantially equal to the inner diameter of wall 80, there being five discs 84 per inch along regenerator 74. Regenerator portion 76 is identical in construction and material to regenerator 74 and comprises an outer shell or region 86 defined by concentric walls 87, 88 and including threads 89 and an interior region 90 provided with packing 91 and a series of perforated plates or disks 92. Regenerators 74 and 76 are positioned against closure or base member 60 so that the interior regions 82 and 90 thereof are in communication with passages 62 and 64, respectively.

Regenerator 16 further comprises a second closure member or top 94 in the form of a metal disk having an outer diameter substantially equal to the diameter of closure member 60 and positioned against regenerators 74 and 76. Closure member 94 includes first and second passages 96 and 97 communicating with the interior regions 82 and 90 of regenerators 74 and 76, respectively. Closure member 94 also includes a passage 98 connected to conduit 36 of the system of FIG. 3. In addition, closure member 94 is provided with passages 100 and 101 connected to conduits 38*a* and 38*b* in the system of FIG. 1. Passages 100 and 101, in turn, are in communication with regions 81 and 86, respectively, of the regenerators. Similarly, closure member 60 includes passages 102 and 103 connected to conduits 32*a* and 32*b* which passages also are in communication with regions 81 and 86, respectively, of the regenerators.

A movable or rotatable valve element 104 identical in construction to valve element 66 is rotatably positioned on closure member 94. In particular, valve 104 has a first passage 106 identical to passage 68 of valve 66 having a vertical portion communicating with passage 06 of member 94, in the position of valve 94 shown in FIG. 2, and a horizontal portion extending around slightly less than half of the circumference of valve 104. A second passage 107 is annular and located between passage 106 and the center of valve 104 similar to passage 70 of valve 66. Passage 107 communicates with passage 98 in top or closure 94. A third passage 108, a mirror image of passage 106 is connected through a passage 109 to passage 107. Passage 108 is in communication with passage 97 in closure member 94 in the position of valve 94 shown in FIG. 2.

Regenerator 16 is completed by a second generally cup-shaped housing including a top wall 144 and a generally vertical annular wall 115 which is secured to closure member 94 thereby defining a chamber 117 therein. Chamber 117 is connected to conduit 114 in the system of FIG. 1. An electric motor 120 is positioned in chamber 117, being secured to top wall 114, and the drive shaft 121 of motor 120 is fixed to valve element 104 whereby operation of motor 120 rotates valve 104. Motor 120 can be of various commercially available types, such as a 30 r.p.m. motor, and would be provided with a conventional power circuit and on-off control (not shown) in a manner readily apparent to those skilled in the art. Valve element 104, in turn, is fixed to one end of a coupling, the other end of which is fixed to valve element 66, so that valve element 66 is moved or rotated in correspondence or in unison with valve element 104. In particular, valve 104 is fixed to a member 124 which is rotatably received or journalled in closure member 94 and is fixed to one end of a shaft 126 which is rotatably supported in corresponding apertures provided in closure members 94 and 60 and which is located between regenerators 74 and 76. The other end of shaft 126 is fixed to a member 128 which is rotatably received or journalled in closure or base 60 and which is fixed to valve element 66. Members 124 and 128 in the present instance are hexagonally shaped, fitting tightly or secured in valve elements 104 and 66, respectively, and fitting rotatably in circular openings of proper diameter in closure members 94 and 60, respectively.

Heat exchanger 24 shown in FIG. 1 is located within a housing preferably of stainless steel and which can have various shapes, in the present instance having a bottom wall 130 which preferably is in the shape of a disk, an annular sidewall 132 extending upwardly and vertically from bottom wall 115, and an top wall portion 134 disposed in a plane generally to the plane of bottom wall 132. Bottom wall 132 is supported by housing bottom wall 43 and can be spaced therefrom by suitable spacing means (not shown). The top wall 134 is provided with an opening to register with the bottom of distilling column 20. The vertical wall of column 20 meets portions of sidewall 132 and top wall 134, being either joined thereto or formed integral therewith. Heat exchanger 24 comprises a continuous length of tubing connected at one end thereof to conduit 18 and connected at the other end thereof to conduit 28 of the system of FIG. 1. Conduits 18 and 32 extend through suitable openings in top 134, there being a gas-tight seal between the top 134 and each conduit. Tubing 24 is coiled or positioned in a series of vertically spaced rows each comprising several convolutions of tubing whereby the the housing can accommodate the length of tubing necessary to boil off the correct amount of oxygen according to the method of the present invention. By way of example, tubing 24 comprises 0.25 inch outer diameter copper tubing having a length of 196 feet. The end of conduit 32 is connected to an opening in top wall 134 to transmit pure oxygen from column 20 and the housing to regenerator 16. A gas-tight seal is provided between conduit 32 and wall 134. In some instances it will be desirable to provide an overflow tube (not shown) disposed vertically in the housing as viewed in FIG. 1 with the top of the tube being the appropriate distance above the top row of heat exchanger tubing 24 and with the other end of the tube being external to the apparatus.

Figure 6:
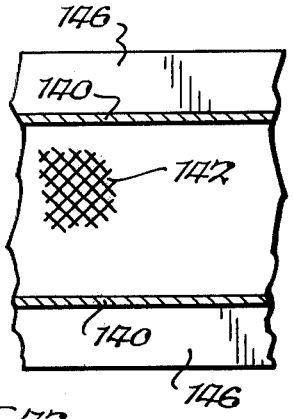
FIG. 6 is a fragmentary sectional view taken about on line 6—6 of FIG. 5.
Figure 5:
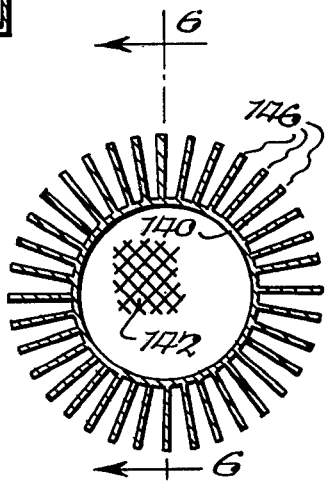
FIG. 5 is a cross sectional view of an alternative form of heat exchange which can be incorporated in the apparatus of FIG. 1.

FIGS. 5 and 6 show an alternative form of heat exchanger which can be employed in the apparatus of the present invention in the form of an internally packed tube provided with external fins. In particular, a cylindrical tube 140 is provided with packing 142 inside comprising 0.03 mesh copper screen which is tightly packed therein. Projecting from the outer surface of the hollow tube 140 are plurality of fins 146 which extend radially outwardly from the common center of tube 140 and which extend along the entire axial length of the tube. By way of example, tube 140 has an inner diameter of about 0.035 inch and an outer diameter of about 0.375 inch, and each fin 146 has a width of 0.25 inch and a thickness of 0.03 inch. Fins 146 are spaced at 0.03 inch intervals around the circumference of tube 140 so that a total of 39 fins are provided. The axial length of tube 140 required to boil off an amount of oxygen equivalent to that boiled off by tube 124 is 6.7 feet.

Refrigeration source 26 located at the top of distillation column 20 comprises a cryogenic refrigerator such as a Gifford-McMahon Cycle refrigerator available commercially from Cryomech Inc. of Syracuse N.Y. A refrigerator of this type capable of producing low temperatures near and below 100° K at a power rating of 200 watts has been found to provide satisfactory results in the system of the present invention wherein the average temperature of operation is −270° F. For a detailed description of the construction and operation of a Gifford-McMahon Cycle refrigerator, reference may be made to U.S. Pat. No. 2,906,101 issued Sept. 29, 1959 and to U.S. Pat. No. 3,119,237 issued Jan. 28, 1964.

When valve members 104 and 66 of regenerator 16 are in the positions shown in FIG. 2, the pressurized incoming air from conduit 14 enters chamber 117 and leaves through passage 106 of valve element 104 as indicated by the arrow in FIG. 2 and flows through passage 96 of member 94 whereupon the air enters region 82 of regenerator 74. As the air flows through region 82, screens 83 serve to collect or filter out particulate impurities from the air. At the same time the air is cooled by exchanging heat with the relatively low temperature oxygen gas from conduit 32*a* which flows through the outer shell or annular region 78 of regenerator 74 and then leaves through conduit 38*a*. The heat transfer is enhanced by the perforated copper plates 84 in region 82 which contact wall 80. The precooled and purified air leaves region 82 through passage 62 in base member 60 and flows through passage 68 of valve element 66 into chamber 58 in a direction indicated by the arrow in FIG. 2. The air leaves regenerator 16 through conduit 18 and according to a preferred mode of the present invention the temperature of this air is about −260° F.

While the regenerator portion 74 is precooling and purifying the incoming air, the other half of the low temperature oxygen gas product and the waste nitrogen gas flow separately through regenerator portion 76. In particular, waste nitrogen gas flows from conduit 34 through passage 73 in base member 60 and into passage 70 of valve element 66 then through passages 72 and 71 whereupon the waste nitrogen gas flows through passage 64 of base member 60 into region 90 of regenerator 76. As the low temperature nitrogen gas flows through region 90, it removes some heat from the regenerator 16 thereby enhancing the air precooling operation being performed by regenerator portion 74 so as to enhance the efficiency of operation. The waste nitrogen gas also will carry with it particulate material previously collected on screens 91 when regenerator 76 was previously used to precool incoming air under control of valve elements 66 and 104. The oxygen gas product flows from conduit 32*b* through the outer shell or annular region 86 and then leaves through conduit 38*b* and then merges with the oxygen gas flow in conduit 38*a*. The low temperature oxygen gas also will remove some heat from regenerator 16 thereby enhancing the efficiency thereof.

When it is desired to reverse the operation of regenerator opposite to that illustrated in FIG. 2, motor 120 is operated to rotate valve elements 104 and 66 simultaneously through 180°. Passage 106 of valve 104 and passage 68 of valve 66 then are in communication with region 90 of regenerator 76 to flow ambient air therethrough. Passage 70, being annular, and passages 72 and 71 of valve 66 connect conduit 34 and passage 73 with passage 62 and the interior 82 of regenerator 74 allowing waste nitrogen to flow therein. In a similar manner, annular passage 107 together with passages 109 and 108 of valve 104 connect passage 96 and interior 82 of regenerator 74 with passage 98 and conduit 36 to exhaust the waste nitrogen gas. The flow of oxygen gas product from conduits 32*a* and 32*b* is divided between regions 78 and 86 as before. By operating motor 120 to rotate valve elements 66 and 104 through another 180° the operation of regenerator 16 can be returned to the position illustrated in FIG. 2. In other words, the valve means comprising valve elements 66 and 104 enable selective control of the incoming air and the waste nitrogen gas between regions 82 and 90 of regenerator portion 74 and 76, respectively.

Regenerator 16 advantageously can be of relatively small size, approximately one foot in overall diameter and one and one-half foot in overall height. The equivalent diameter packing in regenerator portions 74 and 76 is relatively small, in the range from about 0,0025 to about 0,0075 inch. The number of parallel threads 81 and 89 in each of the outer annular regions 78 and 86, respectively, is about 25 threads. Through the use of empirical formulas that apply to turbulent flow through regenerators, it was determined that the inefficiency of interior regions 82, 90 was only about 0.6 percent with a total incremental temperature of about 2° F and that the inefficiency of the outer shells 78 and 86 was only about 5.18 percent with an incremental temperature of about 17.4° F. From these results it was determined that the total refrigeration loss through the regenerator 16 would be within acceptable limits desired for the system as determined by such factors as the desired size and power rating of refrigerator 26.

The 1–14 atmospheres or approximately 200 p.s.i. range of compressor 12 was selected because the temperature in the lower region of distillation column 20 is about 196° K, and in this region, in particular the region containing heat exchanger 24 and liquid oxygen bath 27, the compressed air is to be liquefied. In addition, the liquid oxygen in distillation column 20 is to be evaporated. The temperature of the incoming compressed air in conduit 18 should be slightly warmer or about 200° K. The air is cooled to this temperature by the action of regenerator 16 previously described. From a vapor pressure curve for air, it can be seen that a temperature of 200° K air will liquefy under a pressure of approximately 200 p.s.i. The liquid air from nozzle 30 increases in oxygen content as it falls through the region 22 or mesh of fine metal filings in column 26. In order to maintain equilibrium according to the physical phenomena of the vapor pressure of oxygen and nitrogen, the vapor rising in column 20 must increase in nitrogen content while the liquid falling in column 20 increases in oxygen content. At the region of the bottom of column 20, the pressure of heat exchanger 24 containing air several degrees warmer than the liquid oxygen causes the liquid to evaporate. Some of the oxygen gas rises up column 20 to continue the process and the remainder is vented through conduit 32 to regenerator 16. The vapor adjacent the bottom of column 20 is about 99% oxygen, the liquid and vapor adjacent the portion of column between nozzle 30 and plates 22 is about 20% oxygen, and the waste gas vented or exhausted from the top of column 20 is about 93% nitrogen. According to a preferred mode of the present invention, the nitrogen gas leaving column 20 has a temperature of about 109° K.

Column 20 can be pressurized to the desired delivery pressure for the oxygen gas product. The refrigeration supplied by refrigerator 26 will condense some of the depleted air adjacent the top of column 20, and an arrangement of trays, screens or other collectors can be provided to collect this condensation as well as to provide a more uniform distillation of liquid over the column area.

The utilization of the low temperature oxygen gas product to precool the incoming air in the system of the present invention advantageously saves about 1756 watts of refrigeration as compared to a system requiring that oxygen be shipped in the cold, liquid form. The vacuum chamber in combination with the super insulation material which houses or encloses the apparatus keeps thermal losses very small. Due to the relatively small size of regenerator 16 and refrigerator 26, the pressurized nature of column 20 and the good thermal insulation, the overall size of the apparatus can be very small.

It is therefore apparent that the present invention accomplishes its intended objects. While a single embodiment of the present invention has been described in detail, this is for the purpose of illustration, not limitation.

I claim:

1. A system for liquefying air, separating the oxygen and nitrogen components of the liquiefied air and delivering oxygen gas of high purity comprising:

a. a distillation column having a rectification region, a source of refrigeration above said region and heat exchanger means below said region, said heat exchanger means being in a bath of liquid oxygen during operation of said system;

b. input conduit means connected to said heat exchanger means for providing input air to be liquefied;

c. means connecting said heat exchanger means to said recitification region of said distillation column for transmitting liquefied air to said region for separation into the oxygen and nitrogen components thereof;

d. output conduit means connected to said distillation column for removing oxygen gas of high purity from said column;

e. means comprising regenerator means operatively connected to said input and output conduits for exchanging heat between said oxygen gas and said air to be liquefied whereby said air is precooled prior to entering said heat exchanger means in said distillation column, said regenerator means having a first region connected to said input conduit means and a second region surrounding said first region in heat exchange relationship therewith and connected to said output conduit means;

f. an insulated housing for said system tending to keep said system at a substantially constant temperature; and g. a plurality of perforated plates of heat conducting material in said first region and in heat exchange relationship with said second region for transferring heat between said regions.

2. A system according to claim 1, further including conduit means connected to said distillation column and to said means exchanging heat between oxygen gas and air for withdrawing waste nitrogen gas from said column and conducting said nitrogen gas through said heat exchanging means.

3. A system according to claim 1, wherein source of refrigeration comprises cryogenic refrigeration means.

4. A system according to claim 1, further including means including compressor means coupled to said input conduit means whereby input air is pressurized prior to precooling.

5. A system according to claim 1, wherein said means for exchanging heat between said oxygen gas and said air comprises regenerator means including two indentical regenerator portions each having a first region and a second region in heat exchange relationship therewith, means connecting said output conduit means to the second regions of said regenerator portions whereby the flow of oxygen gas is divided substantially equally between said second regions, and valve means connected to said input conduit means and to said first regions of said regenerator portions for selectively controlling the flow of incoming air through either of said first regions.

6. A system according to claim 5, furtther including conduit means connected to said distillation column and to said means exchanging heat between said oxygen gas and said air, said conduit means withdrawing waste nitrogen gas from said column, said valve means being connected to said conduit means whereby when incoming air flows through the first region of one of said regenerator portions waste nitrogen gas flows through the first region of the outer of said regenerator portions.

7. A system according to claim 1, wherein said heat exchanger means in said bath of liquid oxygen comprises a continuous length of tubing of heat transferring material.

8. A system according to claim 1, wherein said heat exchanger means in said bath of liquid oxygen comprises a continuous length of tubing having a plurality of fins extending radially outwardly from said tubing and axially along said tubing.

9. A system according to claim 1, wherein said insulating housing comprises spaced apart inner and outer housing portions and an evacuated region therebetween, said inner housing portion comprising a plurality of layers of superinsulation material.

10. A system for liquefying air, separating the oxygen and nitrogen components of the liquiefied air and delivering oxygen gas of high purity comprising:

a. a distillation column having a rectification region, a source of refrigeration above said region and heat exchanger means below said region, said heat exchanger means being in a bath of liquid oxygen during operation of said system;

b. input conduit means connected to said heat exchanger means for providing input air to be liquefied;

c. means connecting said heat exchanger means to said rectification region of said distillation column for transmitting liquefied air to said region for separation into the oxygen and nitrogen components thereof;

d. output conduit means connected to said distillation column for removing oxygen gas of high purity from said column;

e. means comprising regenerator means operatively connected to said input and output conduits for exchanging heat between said oxygen gas and said air to be liquefied whereby said to air is precooled prior to entering said heat exchanger means in said distillation column, said regenerator means having a first region connected to said input conduit means and a second region surrounding said first region in heat exchange relationship therewith and connected to said output conduit means;

f. an insulated housing for said system tending to keep said system at a substantially constant temperature; and g. packing material in said first region of said regenerator means for removing particulate material from the air and a plurality of thread members in said region.

* * * * *

UNITED STATES PATENT AND TRADEMARK OFFICE

CERTIFICATE OF CORRECTION

PATENT NO. : 4,017,284

DATED : April 12, 1977

INVENTOR(S) : William E. Gifford

It is certified that error appears in the above-identified patent and that said Letters Patent are hereby corrected as shown below:

change assignee "Cryox Corporation" to --Cryox Corp.--

Claim 6, Line 9, "outer of said" should be --other of said--.

Claim 10. e. Line 4 "to" before "air" should be deleted.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*